US012156617B2

(12) United States Patent
Shimada et al.

(10) Patent No.: US 12,156,617 B2
(45) Date of Patent: Dec. 3, 2024

(54) TOILET APPARATUS

(71) Applicant: TOTO LTD., Kitakyushu (JP)

(72) Inventors: Mitsuhiro Shimada, Kitakyushu (JP); Hinako Kurashima, Kitakyushu (JP); Daisuke Suzawa, Kitakyushu (JP); Katsumi Yamanaka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 149 days.

(21) Appl. No.: 18/160,505

(22) Filed: Jan. 27, 2023

(65) Prior Publication Data

US 2023/0284845 A1 Sep. 14, 2023

(30) Foreign Application Priority Data

Jan. 28, 2022 (JP) ..... 2022-012437

(51) Int. Cl.
*A47K 13/24* (2006.01)

(52) U.S. Cl.
CPC ..... *A47K 13/24* (2013.01)

(58) Field of Classification Search
CPC ..... A47K 13/14
USPC ..... 4/300
See application file for complete search history.

(56) References Cited

U.S. PATENT DOCUMENTS

| | | | | |
|---|---|---|---|---|
| 10,383,606 | B1 * | 8/2019 | McCord | G01N 33/493 |
| 2020/0187863 | A1 * | 6/2020 | Tu | A47K 13/24 |
| 2022/0163514 | A1 * | 5/2022 | Tayfun | G01N 33/521 |
| 2022/0395149 | A1 * | 12/2022 | Shimazu | A61B 5/207 |

FOREIGN PATENT DOCUMENTS

| | | |
|---|---|---|
| JP | 200661296 A | 3/2006 |
| JP | 2021-55522 A | 4/2021 |

OTHER PUBLICATIONS

Japanese Office Action issued on Sep. 5, 2023 in corresponding application No. 2022-012437; 6 pages.

* cited by examiner

*Primary Examiner* — Huyen D Le
(74) *Attorney, Agent, or Firm* — Maier & Maier, PLLC

(57) ABSTRACT

A toilet apparatus includes: a toilet seat disposed above a toilet bowl; an image sensor photographing an inside of a bowl of the toilet bowl; and a control unit controlling the image sensor to execute an automatic photographing mode of automatically photographing the inside of the bowl. When acquiring a user's photographing intention information indicating whether or not the user has an intention to photograph the inside of the bowl, the control unit switches between executing and stopping of the automatic photographing mode based on the acquired photographing intention information.

5 Claims, 7 Drawing Sheets

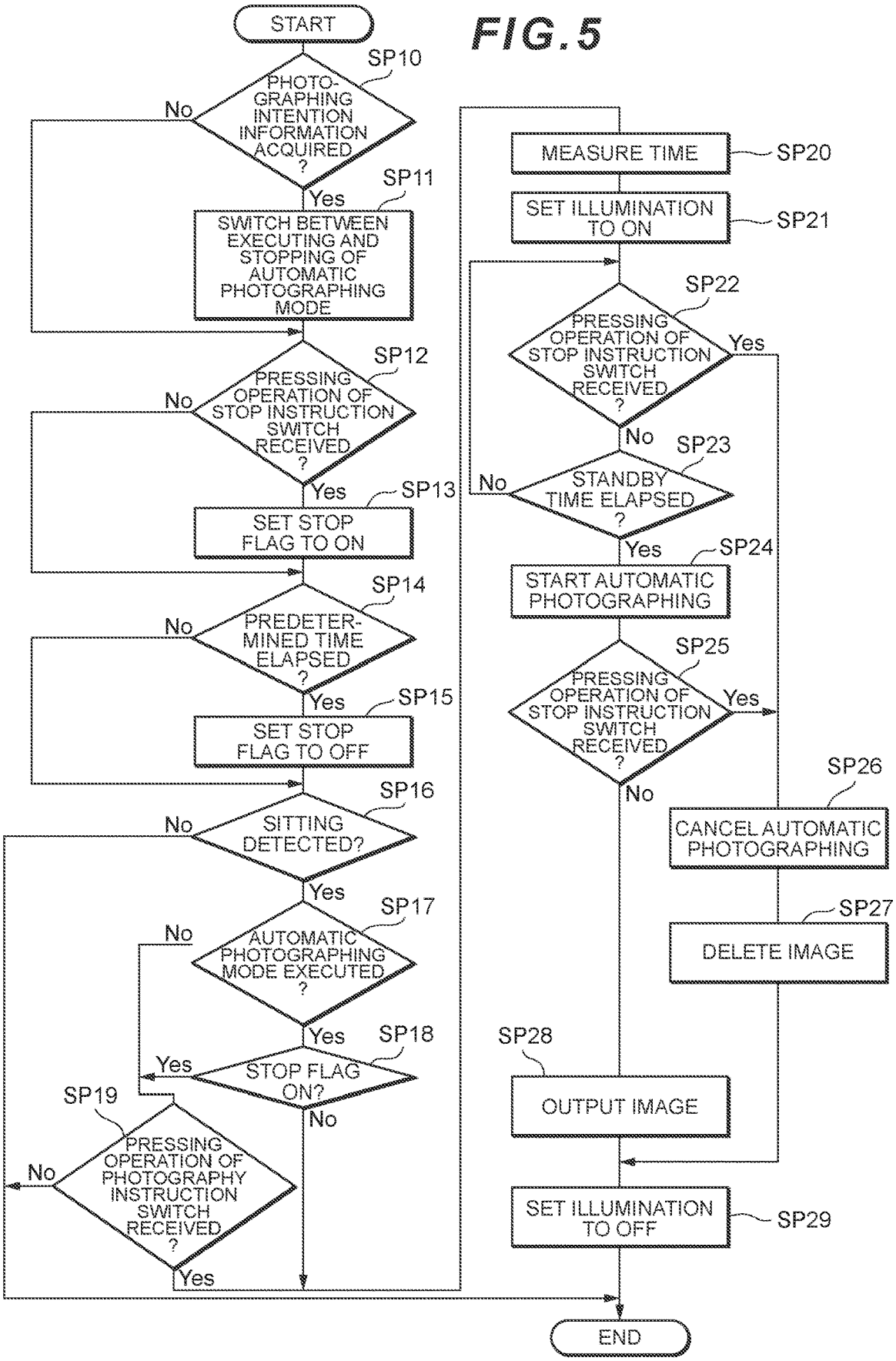
FIG. 5
START
SP10
PHOTO-GRAPHING INTENTION INFORMATION ACQUIRED ?
No
Yes
SP11
SWITCH BETWEEN EXECUTING AND STOPPING OF AUTOMATIC PHOTOGRAPHING MODE
SP12
PRESSING OPERATION OF STOP INSTRUCTION SWITCH RECEIVED ?
No
Yes
SP13
SET STOP FLAG TO ON
SP14
PREDETER-MINED TIME ELAPSED ?
No
Yes
SP15
SET STOP FLAG TO OFF
SP16
SITTING DETECTED?
No
Yes
SP17
AUTOMATIC PHOTOGRAPHING MODE EXECUTED ?
No
Yes
SP18
STOP FLAG ON?
Yes
No
SP19
PRESSING OPERATION OF PHOTOGRAPHY INSTRUCTION SWITCH RECEIVED ?
No
Yes
MEASURE TIME
SP20
SET ILLUMINATION TO ON
SP21
SP22
PRESSING OPERATION OF STOP INSTRUCTION SWITCH RECEIVED ?
Yes
No
SP23
STANDBY TIME ELAPSED ?
No
Yes
SP24
START AUTOMATIC PHOTOGRAPHING
SP25
PRESSING OPERATION OF STOP INSTRUCTION SWITCH RECEIVED ?
Yes
No
SP26
CANCEL AUTOMATIC PHOTOGRAPHING
SP27
DELETE IMAGE
SP28
OUTPUT IMAGE
SET ILLUMINATION TO OFF
SP29
END

TOILET APPARATUS

BACKGROUND

Field

The present invention relates to a toilet apparatus.

Description of the Related Art

Japanese Patent Application Publication No. 2021-55522 discloses a toilet seat device including an image sensor. The toilet seat device automatically photographs an inside of a bowl of a toilet bowl by using the image sensor.

SUMMARY

However, when a toilet bowl is used by multiple users, there may be cases where some of the users do not wish to have the inside of the bowl photographed. In such cases, when automatically photographing the inside of the bowl as in the toilet seat device described in Japanese Patent Application Publication No. 2021-55522, even users who do not wish to be photographed may accidentally be photographed, causing discomfort to the users.

The present invention has been made in view of these problems, and an object of the present invention is to prevent discomfort to users who do not wish to have the inside of a bowl automatically photographed.

To solve the above problems, a toilet apparatus according to a first embodiment of the present invention includes: a toilet seat disposed above a toilet bowl; an image sensor for photographing an inside of a bowl of the toilet bowl; and a control unit for controlling the image sensor to execute an automatic photographing mode of automatically photographing the inside of the bowl, wherein, when acquiring user's photographing intention information indicating whether or not a user has an intention to photograph the inside of the bowl, the control unit switches between executing and stopping of the automatic photographing mode based on the acquired photographing intention information.

With this configuration, the automatic photographing mode can be switched to stop, for example, if the photographing intention information indicates that the user does not have an intention to photograph the inside of the bowl of the toilet bowl. Thus, the user can avoid having the inside of the bowl automatically photographed, which can prevent discomfort to the user who does not wish to be photographed.

The toilet apparatus according to a second aspect of the present invention further includes a stop instruction unit for receiving a stop instruction provided by the user, wherein the control unit switches the automatic photographing mode from executing to stopping when the stop instruction unit receives the stop instruction while the automatic photographing mode is being executed.

With this configuration, the automatic photographing mode can be switched to stop according to the stop instruction provided by the user even when the automatic photographing mode is executed. This can improve the usability of the toilet apparatus without requiring any extra effort to perform photographing for users who wish to be photographed, and can protect the privacy of users who do not wish to be photographed.

In the toilet apparatus according to a third aspect of the present invention, when switching the automatic photographing mode from executing to stopping, the control unit deletes an image obtained by the photographing before the stopping.

With this configuration, when switching the automatic photographing mode from executing to stopping, the image photographed before the stopping is deleted, whereby the privacy of the user who does not wish to be photographed can be further protected.

The toilet apparatus according to a fourth aspect of the present invention further includes: a sitting detection unit for detecting sitting of the user on the toilet seat, wherein the control unit starts photographing in the automatic photographing mode when a predetermined time elapses after the sitting detection unit detects the sitting, and the control unit switches the automatic photographing mode from executing to stopping if the stop instruction unit receives the stop instruction during the predetermined time.

With this configuration, even when the user sitting on the toilet seat suddenly changes his/her mind and does not wish to be photographed, the automatic photographing mode is switched from executing to stopping according to the stop instruction provided by the user, which can further improve the usability of the toilet apparatus.

The toilet apparatus according to a fifth aspect of the present invention further includes: a photography instruction unit for receiving a photography instruction provided by the user, wherein the control unit switches the automatic photographing mode from stopping to executing when the photography instruction unit receives the photography instruction.

With this configuration, the automatic photographing mode is switched from stopping to executing when the photography instruction unit receives the photography instruction, even if the automatic photographing mode is stopped. This can improve the usability of the toilet apparatus for a user who suddenly changes his/her mind and wishes to be photographed.

Accordingly, the present invention can prevent discomfort to users who do not wish to have the inside of the bowl automatically photographed.

BRIEF DESCRIPTION OF THE DRAWINGS

FIG. 5 is a flowchart illustrating an example of a processing flow performed by the toilet apparatus.

DETAILED DESCRIPTION

Hereinafter, embodiments of the present invention will be described with reference to the accompanying drawings. To make the description easier to understand, identical components in each drawing are denoted by the same sign as much as possible, and a duplicate description is omitted below.

First Embodiment

Figure 1:
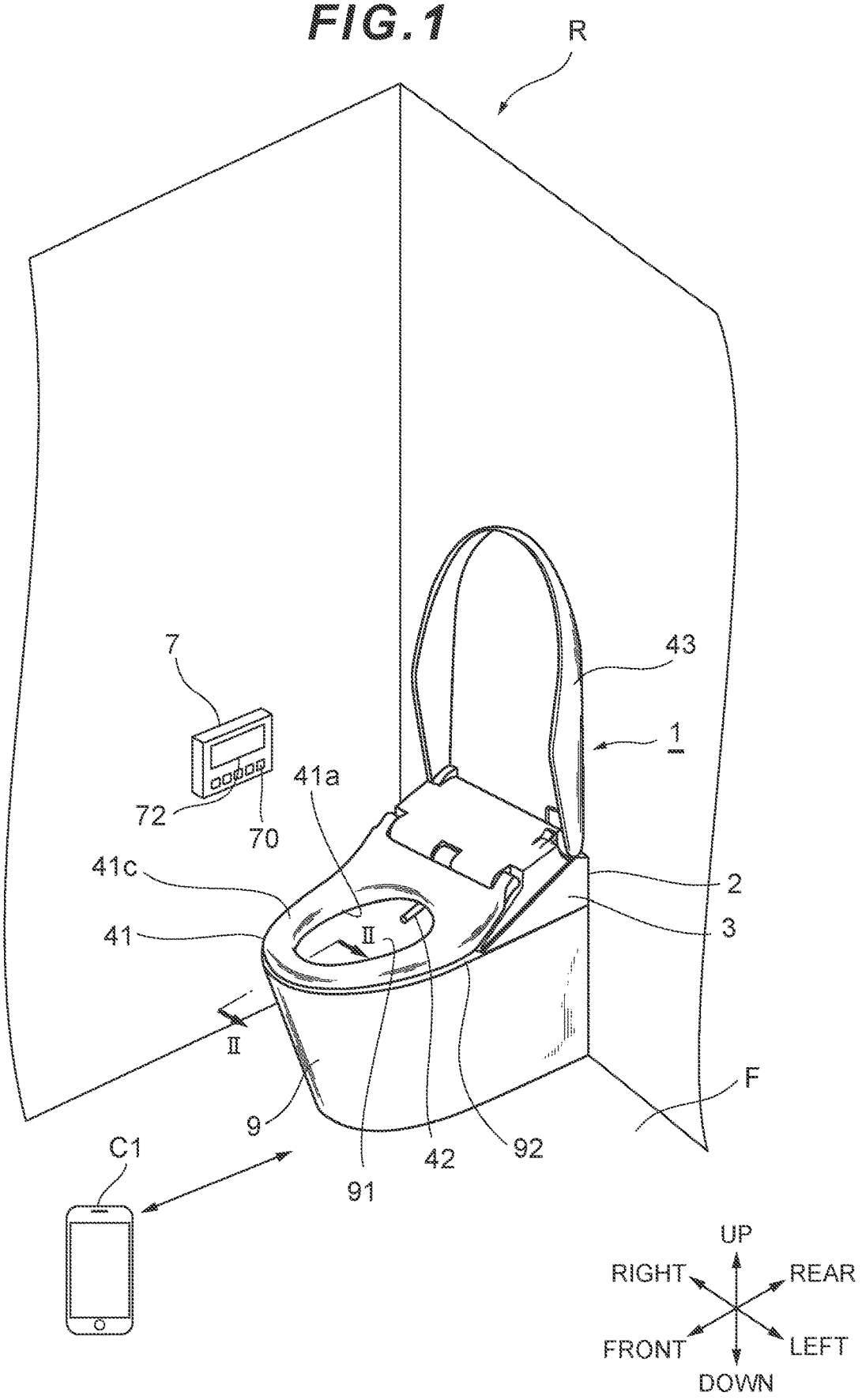
FIG. 1 is a perspective view illustrating a toilet room where a toilet apparatus is installed.
Figure 2:
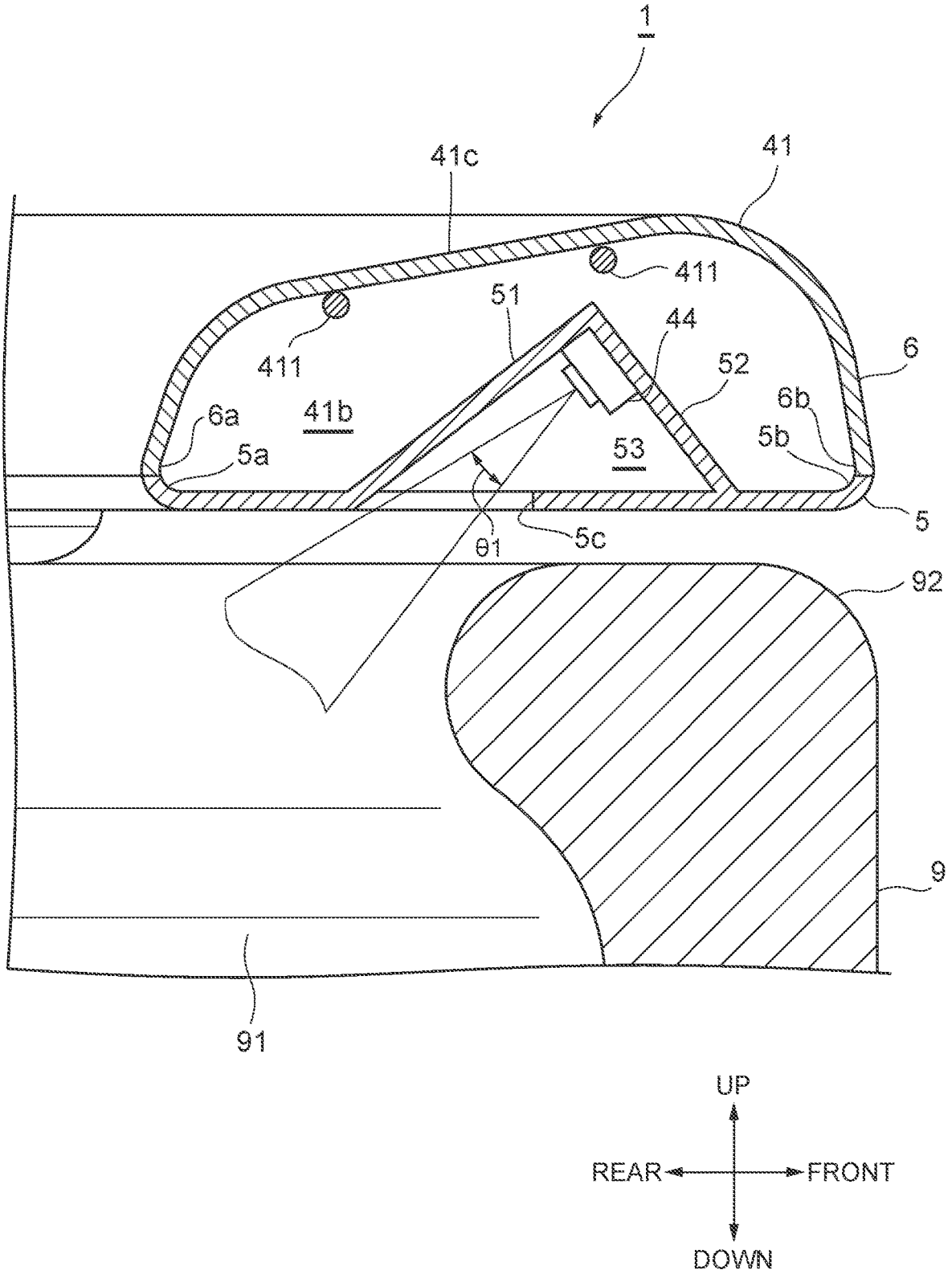
FIG. 2 is a cross-sectional view taken along the line II-II of FIG. 1.
Figure 3:
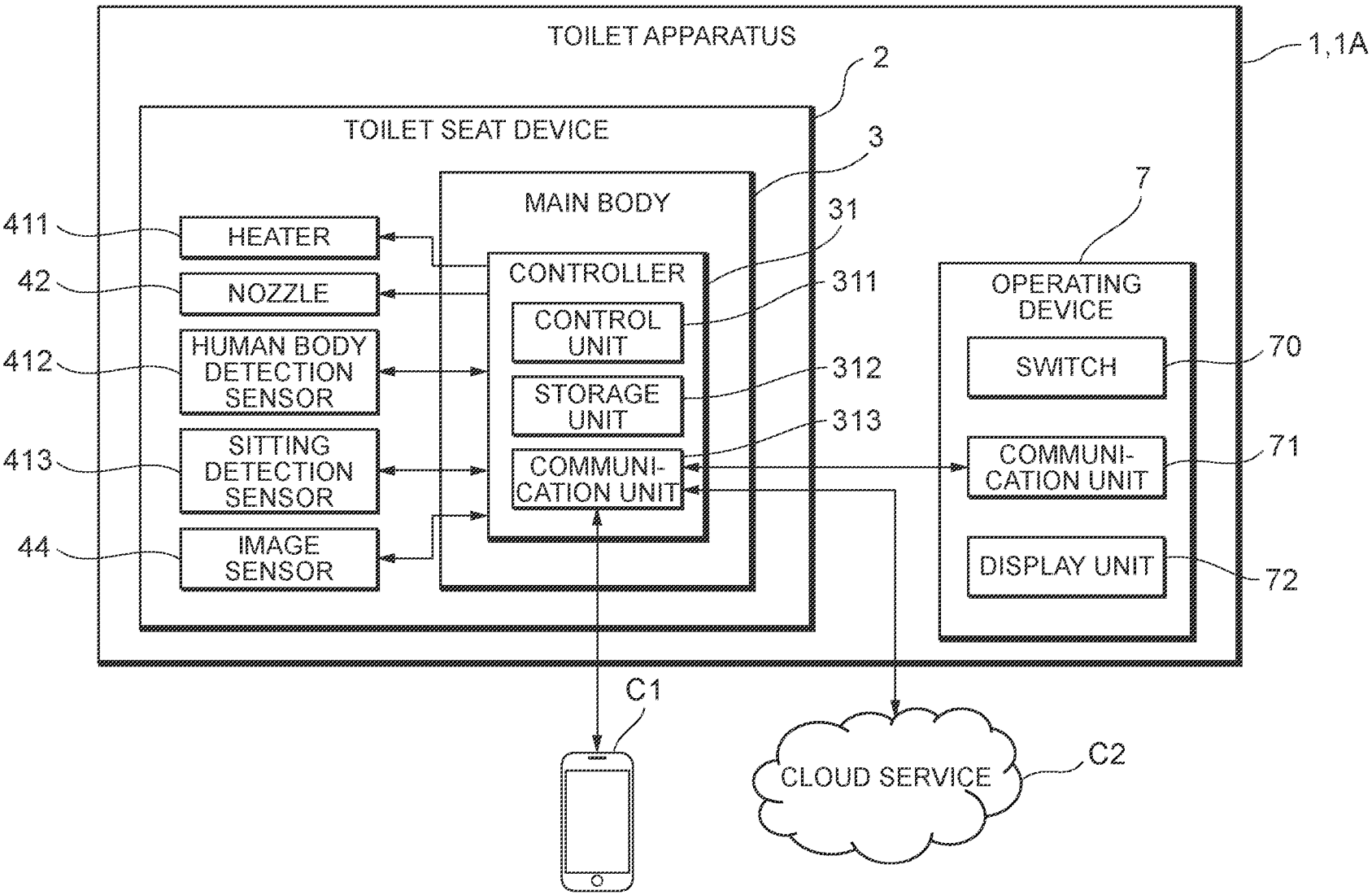
FIG. 3 is a block diagram of the toilet apparatus.
Figure 4:
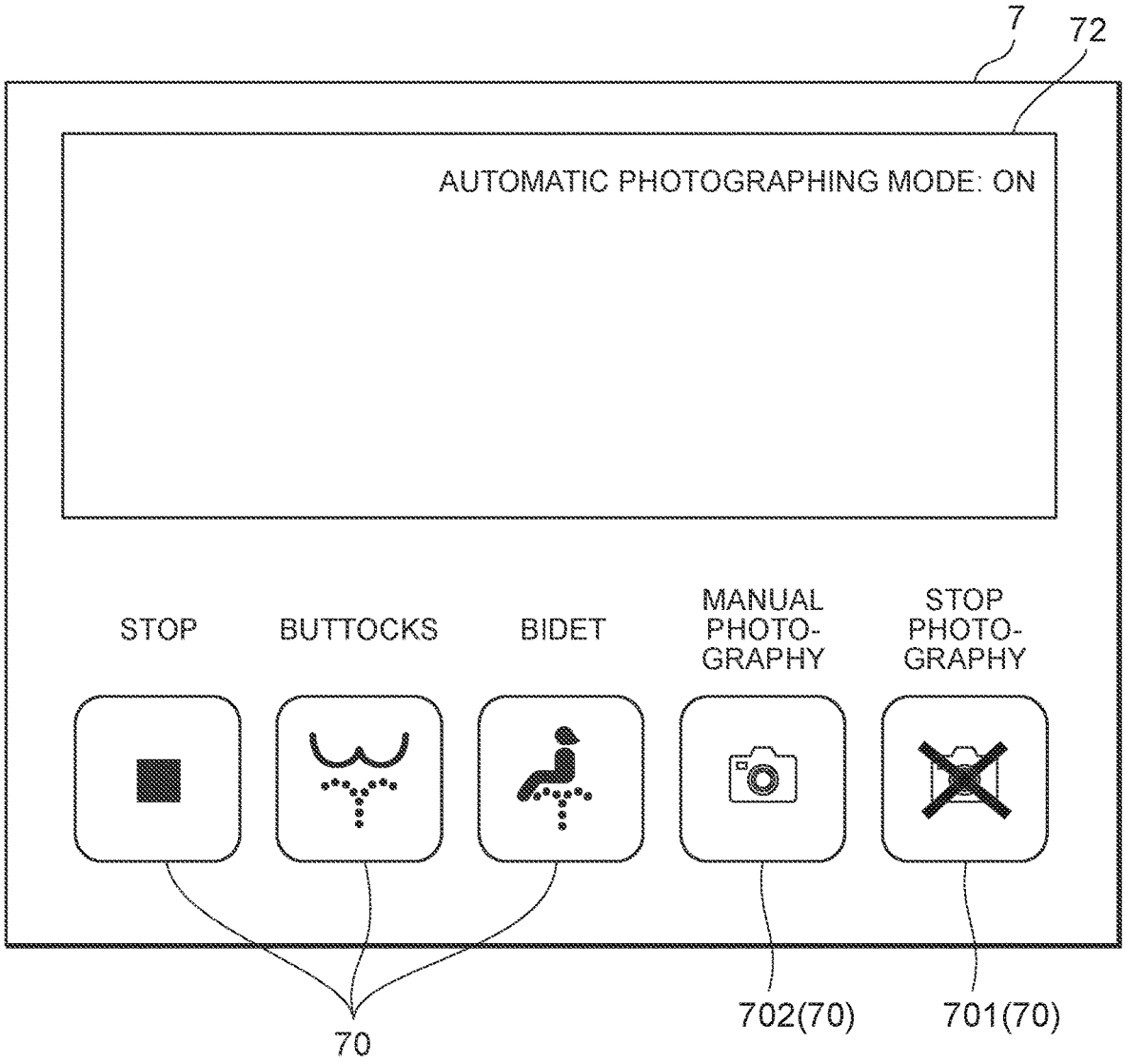
FIG. 4 is a front view illustrating an example of an operating device illustrated in FIG. 1.

First of all, a toilet apparatus 1 according to a first embodiment of the present invention will be described with reference to FIGS. 1 to 5. FIG. 1 is a perspective view illustrating a toilet room R where the toilet apparatus 1 is installed; FIG. 2 is a cross-sectional view taken along the line II-II of FIG. 1; FIG. 3 is a block diagram of the toilet apparatus 1; FIG. 4 is a front view illustrating an example of an operating device 7 illustrated in FIG. 1; and FIG. 5 is a flowchart illustrating an example of a processing flow performed by the toilet apparatus 1.

<Entire Configuration>

As illustrated in FIG. 1, a toilet bowl 9 is installed on a floor surface F of the toilet room R. The toilet bowl 9 is a stool bowl and has a bowl 91 for receiving user's feces and a rim 92 erected around the bowl 91. For example, when a user operates a flush operation unit (not shown) provided in the toilet room R, flush water is supplied to the bowl 91 to flush the bowl 91 and discharge feces from the bowl 91. The flush operation unit can take various forms, such as an operating lever provided in the toilet room R or a switch 70 provided in the operating device 7 to be described later.

The toilet apparatus 1 is applied to this toilet bowl 9. The toilet apparatus 1 includes a toilet seat device 2 and the operating device 7. In the following description, as viewed from the user sitting on a toilet seat 41 described later, the front is referred to as "front," the rear as "rear," the left as "left," and the right as "right". In addition, the upward in the vertical direction is referred to as "up", and the downward in the vertical direction as "down".

The toilet seat device 2 is attached to an upper portion of the toilet bowl 9 and includes a main body 3, the toilet seat 41, a nozzle 42, and a toilet lid 43. The toilet seat device 2 may be detachably attached to the toilet bowl 9 or may be attached integrally onto the toilet bowl 9.

The toilet seat 41 is an element on which the user sits during defecation and supports the buttocks of the user at its seating surface 41*c*. The toilet seat 41 is annular in shape and has an opening 41*a* formed at its center. The bowl 91 is opened through the opening 41*a* when the toilet seat 41 is placed on the rim 92. The toilet seat 41 is pivotally supported at its rear end, and thereby the toilet seat 41 is rotatable between a posture where it is placed on the rim 92 and a posture where it is located away from the rim 92 to make the bowl 91 opened largely.

As illustrated in FIG. 2, the toilet seat 41 has a bottom plate 5 and a top plate 6. Both the bottom plate 5 and the top plate 6 are formed of resin material. An inner peripheral edge 5*a* of the bottom plate 5 and an inner peripheral edge 6*a* of the top plate 6 are welded together, and an outer peripheral edge 5*b* of the bottom plate 5 and an outer peripheral edge 6*b* of the top plate 6 are welded together, whereby the bottom plate 5 and the top plate 6 are joined to constitute the toilet seat 41. Center portions of the bottom plate 5 and top plate 6 are arranged to be spaced apart from each other, thereby forming a void 41*b* inside the toilet seat 41. In addition to this configuration, the toilet seat 41 can take various forms, such as a configuration in which ribs erected on an upper surface of the bottom plate 5 and ribs erected on a lower surface of the top plate 6 are joined together by welding.

When the toilet seat 41 is placed on the rim 92 of the toilet bowl 9, the bottom plate 5 is arranged such that its part faces the rim 92 in the up-down direction, while the other part thereof is located above the bowl 91 as illustrated in FIG. 2. The other part of the bottom plate 5 is provided with an opening 5*c*. An image sensor 44 is provided, for example, in the void 41*b* behind the toilet seat 41. The image sensor 44 serves as a photographing unit that photographs the inside of the bowl 91 via the opening 5*c*. The image sensor 44 can photograph an object that is present within the angle of view θ1 in the side view as illustrated in FIG. 2. The configuration of the surroundings of the image sensor 44 will be described later.

The top plate 6 is arranged such that the seating surface 41*c*, which is a curved surface, faces upward. A heater 411 is attached to the lower surface of the top plate 6. The heater 411 is an electric heating wire that generates Joule heat when supplied with electric power.

The nozzle 42 illustrated in FIG. 1 is used to wash a user's local area. The nozzle 42 is configured such that it can advance and retract from the main body 3 within the bowl 91 by an electric motor (not shown). By opening an electromagnetic valve (not shown) when the nozzle 42 is located in the bowl 91, the nozzle 42 discharges water toward the user's local area.

The toilet lid 43 is pivotally supported at its rear end and is configured to be rotatable between a posture where it covers the toilet seat 41 and a posture where it makes the toilet seat 41 opened.

The operating device 7 is to operate the toilet seat device 2 and is installed, for example, on a wall surface of the toilet room R. The operating device 7 has a plurality of switches 70 corresponding to a plurality of operations of the toilet seat device 2. As illustrated in FIG. 3, the operating device 7 further has a communication unit 71 and a display unit 72. The communication unit 71 transmits and receives signals wirelessly from and to a communication unit 313 of the toilet seat device 2 described below. The display unit 72 is a liquid crystal panel provided on an outer side surface of the operating device 7 and displays various information.

As in the operating device 7, a portable information terminal C1 may be used to remotely operate the toilet seat device 2 by performing wireless communication with the toilet seat device 2. The portable information terminal C1 is, for example, a smartphone or tablet device owned by the user. However, the portable information terminal C1 is not limited thereto, but may be any terminal that can be carried by the user.

As illustrated in FIG. 3, a controller 31 is arranged in the main body 3 of the toilet seat device 2. The controller 31 is entirely or partially constituted of either an analog circuit or a digital processor or memory. The controller 31 includes a control unit 311, a storage unit 312, and the communication unit 313 as functional blocks. The control unit 311 conducts various controls based on a signal or the like received by the controller 31 from the outside. The storage unit 312 stores therein various setting information and parameters. The communication unit 313 transmits and receives signals to and from the outside of the toilet seat device 2, such as the user's portable information terminal C1 or a cloud service C2, for example.

The software module incorporated in the controller 31 is not necessarily divided into the functional blocks illustrated in FIG. 3. That is, the actual analog circuit and module may be configured to function as the plurality of functional blocks illustrated in FIG. 3, or they may be further subdivided. The configuration of the controller 31 can be changed as appropriate by a person skilled in the art as long as the controller 31 can be configured to execute the processing described later.

The controller 31 is connected to the heater 411, the nozzle 42, a human body detection sensor 412 as a human body detection unit, a sitting detection sensor 413 as a seating detection unit, and the image sensor 44 so that the controller 31 can transmit control signals thereto. The human body detection sensor 412 detects the user (human body) entering the toilet room R. The sitting detection sensor 413 is to detect the sitting of the user on the toilet seat 41. The controller 31 can receive detection signals from the human body detection sensor 412 and sitting detection sensor 413 or can receive an image signal from the image sensor 44.

Operation Example

When the control unit 311 of the controller 31 determines that the user sits on the toilet seat 41, based on a signal received from the sitting detection sensor 413, the control unit 311 transmits a control signal to the heater 411 (that is, the heater 411 is supplied with electric power). Thus, the temperature of the top plate 6 increases as the top plate 6 receives Joule heat generated from the heater 411, whereby heating of the toilet seat 41 is performed.

When the user presses down the switch 70 of the operating device 7 corresponding to the start of local-area washing, the communication unit 71 of the operating device 7 generates a signal corresponding to the switch 70 and transmits the signal wirelessly to the toilet seat device 2. In the toilet seat device 2, this signal is received at the communication unit 313 of the controller 31, and the controller 31 transmits a control signal to the nozzle 42, for example. The nozzle 42 that has received the control signal advances from the main body 3 into the bowl 91 and discharges water supplied from an opened electromagnetic valve, toward the local area of the user.

The control unit 311 of the controller 31 controls the image sensor 44 after or during defecation of the user to thereby execute an automatic photographing mode in which the inside of the bowl 91 is automatically photographed (hereinafter referred to as "automatic photographing" as appropriate) without any user's operation. In the automatic photographing, the inside of the bowl 91 is photographed a plurality of number of times during the predetermined time. The image sensor 44 transmits an image signal corresponding to a photographed image of the inside of the bowl 91 to the controller 31. The controller 31 that has received the image signal stores the image based on the image signal in the storage unit 312. Additionally, the control unit 311 determines at least one of the presence or absence, color, shape, and amount of user's feces from the image based on the image signal according to a prescribed program. The communication unit 313 of the controller 31 generates a signal corresponding to this determination result and transmits it to the external cloud service C2. By accessing this cloud service C2 and acquiring the above determination result, medical professionals, etc., are able to grasp the health condition of the user and provide advice based on it.

<Prevention of Discomfort>

The toilet apparatus 1 is devised to prevent discomfort to users who do not wish to have the inside of the bowl 91 automatically photographed. Hereinafter, this point will be described.

When acquiring user's photographing intention information indicating whether or not a user has an intention to photograph the inside of the bowl 91, the control unit 311 of the controller 31 switches the setting of the automatic photographing mode between the executing and stopping based on the acquired photographing intention information. It is noted that as illustrated in FIG. 4, in order for the user to understand the state of executing (ON) or stopping (OFF) of the automatic photographing mode, the letter such as ON or OFF may be displayed on the display unit 72 of the operating device 7. For example, the communication unit 313 may acquire (receive) the photographing intention information from the portable information terminal C1 or cloud service C2. Alternatively, the control unit 311 may acquire the photographing intention information from the storage unit 312 or operating device 7 provided in the main body 3.

As illustrated in FIG. 4, the plurality of switches 70 of the operating device 7 includes a stop instruction switch 701 as a stop instruction unit that receives a stop instruction provided by the user and a photography instruction switch 702 as a photography instruction unit that receives a photography instruction provided by the user. The control unit 311 switches the automatic photographing mode from executing to stopping when the stop instruction switch 701 receives the stop instruction while the automatic photographing mode is being executed, i.e., when the stop instruction switch 701 is pressed down. When switching the automatic photographing mode from executing to stopping, the control unit 311 deletes, from the storage unit 312 of the controller 31, an image obtained by the photographing before the stopping. The control unit 311 switches the automatic photographing mode from stopping to executing when the photography instruction switch 702 receives a photography instruction, i.e., when the photography instruction switch 702 is pressed down.

The control unit 311 starts photographing in the automatic photographing mode when a predetermined time elapses after the sitting detection sensor 413 detects the sitting. The control unit 311 switches the automatic photographing mode from executing to stopping if the stop instruction switch 701 is pressed down during the predetermined time.

Hereinafter, a description will be given of an example of a sequential processing flow for preventing discomfort to users with reference to FIG. 5. The sequential processing illustrated in FIG. 5 is repeatedly conducted, for example, every few seconds.

(Step SP10)

The control unit 311 determines whether or not the communication unit 313 acquires the user's photographing intention information from the portable information terminal C1 of the user, for example. If the determination is affirmative, the processing proceeds to a process in step SP11. On the other hand, if the determination is negative, the processing proceeds to a process in step SP12.

(Step SP11)

The control unit 311 switches to the executing of the automatic photographing mode when the acquired photographing intention information indicates that the user has an intention to photograph the inside of the bowl 91. The control unit 311 switches to the stopping of the automatic photographing mode when the acquired photographing intention information indicates that the user does not have an intention to photograph the inside of the bowl 91. Then, the processing proceeds to a process in step SP12.

(Step SP12)

The control unit 311 determines whether or not the stop instruction switch 701 receives a pressing operation. If the determination is affirmative, the processing proceeds to a process in step SP13. On the other hand, if the determination is negative, the processing proceeds to a process in step SP14.

(Step SP13)

The control unit 311 sets a stop flag set in the storage unit 312 to ON. Then, the processing proceeds to a process in step SP14.

(Step SP14)

The control unit 311 determines whether or not a predetermined time elapses after the stop flag is set to ON. If the determination is affirmative, the processing proceeds to a process in step SP15. On the other hand, if the determination is negative, the processing proceeds to a process in step SP16.

(Step SP15)

The control unit 311 sets a stop flag to OFF. Then, the processing proceeds to a process in step SP16.

(Step SP16)

The control unit 311 determines whether or not the sitting detection sensor 413 detects the sitting of the user on the toilet seat 41. If the determination is affirmative, the processing proceeds to a process in step SP17. On the other hand, if the determination is negative, the sequential processing illustrated in FIG. 5 is ended.

(Step SP17)

The control unit 311 determines whether or not the automatic photographing mode is set to be executed. If the determination is affirmative, the processing proceeds to a process in step SP18. On the other hand, if the determination is negative, the processing proceeds to a process in step SP19.

(Step SP18)

The control unit 311 determines whether or not the stop flag is set to ON. If the determination is affirmative, the processing proceeds to a process in step SP19. On the other hand, if the determination is negative, the processing proceeds to a process in step SP20.

(Step SP19)

The control unit 311 determines whether or not the photography instruction switch 702 receives a pressing operation. If the determination is affirmative, the processing proceeds to a process in step SP20. On the other hand, if the determination is negative, the sequential processing illustrated in FIG. 5 is ended.

(Step SP20)

The control unit 311 starts measuring the time. Then, the processing proceeds to a process in step SP21.

(Step SP21)

The control unit 311 controls the image sensor 44 to set an illumination provided at the image sensor 44 to ON in order to give advance notice to the user to start photographing. Then, the processing proceeds to a process in step SP22.

(Step SP22)

The control unit 311 determines whether or not the user's pressing operation of the stop instruction switch 701 is received. If the determination is affirmative, the processing proceeds to a process in step SP26. On the other hand, if the determination is negative, the processing proceeds to a process in step SP22.

(Step SP23)

The control unit 311 determines whether or not the measured time has passed a prescribed standby time. If the determination is affirmative, the processing proceeds to a process in step SP24. On the other hand, if the determination is negative, the processing returns to the process in step SP22.

(Step SP24)

The control unit 311 controls the image sensor 44 to start automatic photographing which involves automatically photographing the inside of the bowl 91. Then, the processing proceeds to a process in step SP25.

(Step SP25)

The control unit 311 determines whether or not a pressing operation of the stop instruction switch 701 is received. If the determination is affirmative, the processing proceeds to a process in step SP26. On the other hand, if the determination is negative, the processing proceeds to a process in step SP28.

(Step SP26)

The control unit 311 switches to the permanent or temporary stopping of the automatic photographing mode. Then, the processing proceeds to a process in step SP27.

(Step SP27)

The control unit 311 deletes the image or images obtained by the automatic photography before switching to the stopping of the automatic photographing mode. In other words, the control unit 311 deletes the image or images obtained by starting the photography in step SP24. Then, the processing proceeds to a process in step SP29.

(Step SP28)

If the determination is negative in step SP25, the control unit 311 determines the presence or absence of user's feces, or the properties of the user's feces, such as the color, shape, and amount of the feces, from the image obtained by the automatic photography. The communication unit 313 generates a signal corresponding to this determination result and transmits it to the external cloud service C2 or portable information terminal C1. Then, the processing proceeds to a process in step SP29.

(Step SP29)

The control unit 311 controls the image sensor 44 to set an illumination provided at the image sensor 44 to OFF. Thus, the sequential processing illustrated in FIG. 5 is ended.

<Action and Effects>

With the above configuration, the automatic photographing mode can be switched to stop, for example, if the photographing intention information indicates that the user does not have an intention to photograph the inside of the bowl 91. Thus, the user can avoid having the inside of the bowl 91 automatically photographed, which can prevent discomfort to the user who does not wish to be photographed.

The control unit 311 switches the automatic photographing mode from executing to stopping when the stop instruction switch 701 receives the stop instruction while the automatic photographing mode is being executed.

With this configuration, the automatic photographing mode can be switched to stop according to the stop instruction provided by the user even when the automatic photographing mode is executed. This can improve the usability of the toilet apparatus without requiring any extra effort to perform photographing for users who wish to be photographed and can protect the privacy of users who do not wish to be photographed.

When switching the automatic photographing mode from executing to stopping, the control unit 311 deletes the image or images obtained by the photographing before the stopping.

With this configuration, since the image photographed before the stopping is deleted when switching the automatic photographing mode from executing to stopping, the privacy of the user who does not wish to be photographed can be further protected.

The control unit 311 starts photographing in the automatic photographing mode when the predetermined time elapses after the sitting detection sensor 413 detects the sitting, and the control unit 311 switches the automatic photographing mode from executing to stopping if the stop instruction switch 701 receives the stop instruction during the predetermined time.

With this configuration, even when the user sitting on the toilet seat 41 suddenly changes his/her mind and does not wish to be photographed, the automatic photographing mode is switched from executing to stopping according to the stop instruction provided by the user, which can further improve the usability of the toilet apparatus.

The control unit 311 switches the automatic photographing mode from stopping to executing when a photography instruction switch 74 receives the photography instruction.

With this configuration, the automatic photographing mode is switched from stopping to executing when the photography instruction switch 74 receives the photography instruction, even if the automatic photographing mode is stopped. This can improve the usability of the toilet apparatus for a user who suddenly changes his/her mind and wishes to be photographed.

Second Embodiment

Figure 6:
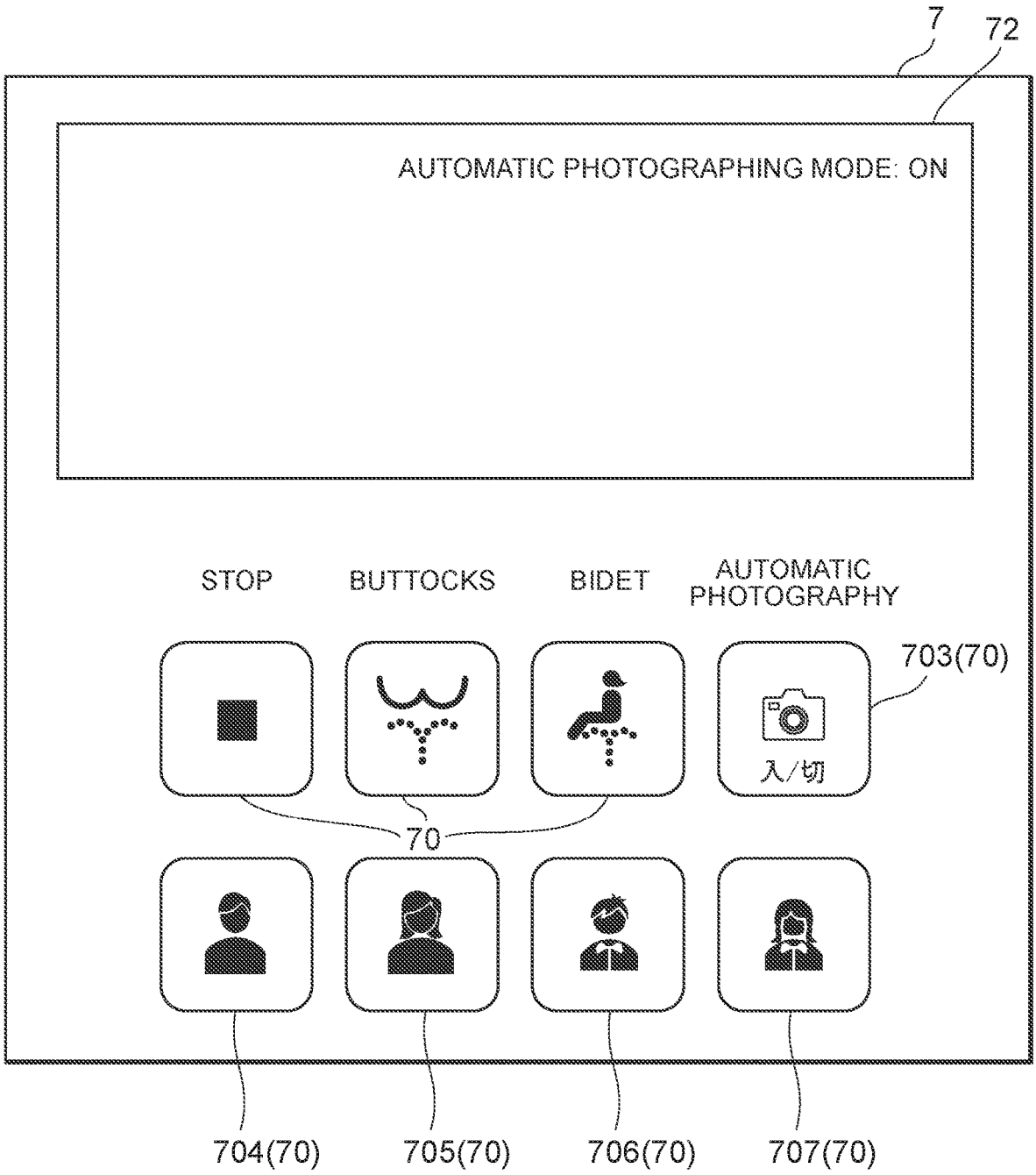
FIG. 6 is a front view illustrating a modification of the operating device illustrated in FIG. 1.
Figure 7:
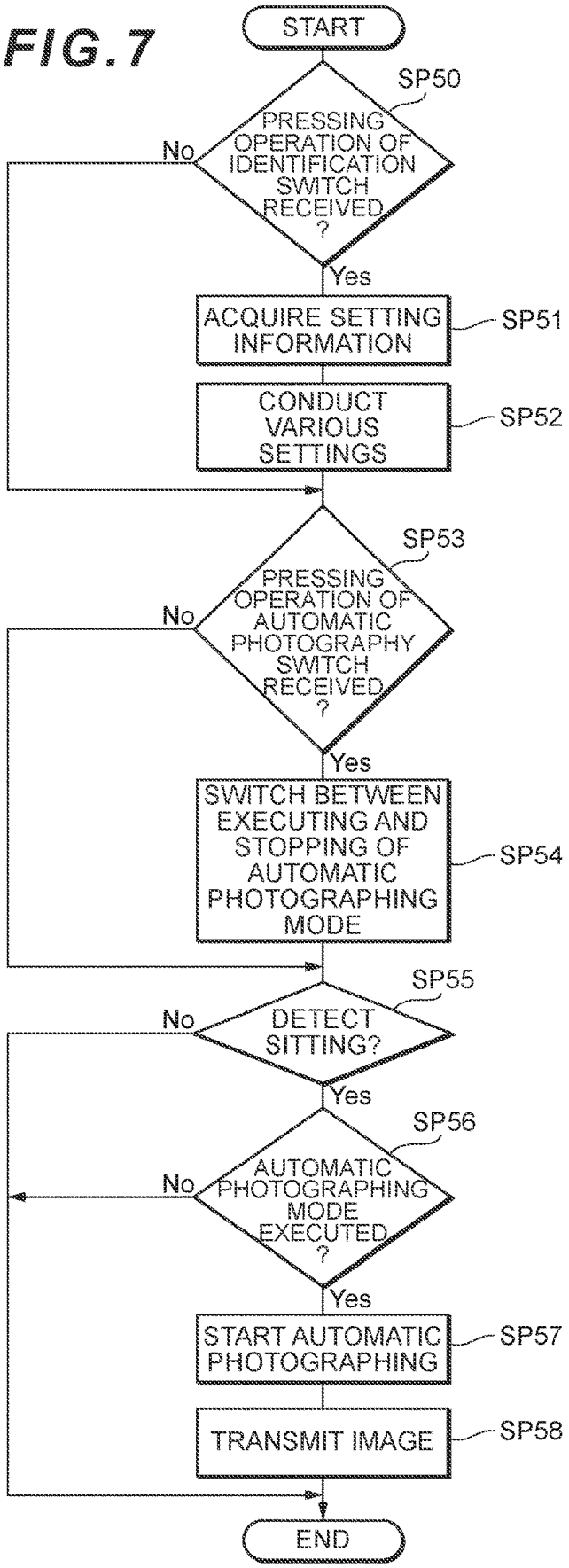
FIG. 7 is a flowchart illustrating a modification of a processing flow performed by the toilet apparatus.

Next, a toilet apparatus 1A according to a second embodiment will be described with reference to FIGS. 3, 6, and 7. FIG. 6 is a front view illustrating a modification of the operating device 7 illustrated in FIG. 1. FIG. 7 is a flowchart illustrating a modification of a processing flow performed by the toilet apparatus 1A. The toilet apparatus 1A according to the second embodiment differs from the toilet apparatus of the first embodiment in the switch 70 provided in the operating device 7 and in the processing flow of the toilet apparatus 1A. Of the toilet apparatus 1A according to the second embodiment, the same component as in the first embodiment is denoted by the same reference sign, and its description is omitted as appropriate.

As illustrated in FIG. 3, the toilet apparatus 1A according to the second embodiment has the same configuration as the toilet apparatus 1 according to the first embodiment. It is noted that as illustrated in FIG. 6, the switches 70 of the operating device 7 in the toilet apparatus 1A include an automatic photography switch 703 and identification switches 704 to 707. The automatic photography switch 703 is a switch for switching between the executing and stopping of the automatic photographing mode. The identification switches 704 to 707 are switches for identifying users. For example, the identification switch 704 is a switch for identifying the "father", the identification switch 705 is a switch for identifying the "mother", the identification switch 706 is a switch for identifying the "boy", and the identification switch 707 is a switch for identifying the "girl".

Hereinafter, a description will be given of an example of a sequential processing flow for preventing discomfort to users with reference to FIG. 7. The sequential processing illustrated in FIG. 7 is repeatedly conducted, for example, every few seconds.

(Step SP50)

The control unit 311 determines whether or not any one of the identification switches 704 to 707 receives a pressing operation. If the determination is affirmative, the processing proceeds to a process in step SP51. On the other hand, if the determination is negative, the processing proceeds to a process in step SP53.

(Step SP51)

The control unit 311 acquires, from the storage unit 312, setting information corresponding to an identification switch which has been pressed down, among the identification switches 704 to 707. The setting information also includes the user's photographing intention information indicating whether or not the user has an intention to photograph the inside of the bowl 91. Then, the processing proceeds to a process in step SP52.

(Step SP52)

The control unit 311 conducts various settings based on the acquired setting information. At this time, the control unit 311 switches between executing and stopping of the automatic photographing mode based on the photographing intention information included in the acquired setting information. For example, when the identification switch 704 is pressed down while the photographing intention information corresponding to the identification switch 704 indicates that the user has an intention to photograph, the control unit 311 switches to the executing of the automatic photographing mode according to the photographing intention information. On the other hand, when the identification switch 705 is pressed down while the photographing intention information corresponding to the identification switch 705 indicates that the user does not have an intention to photograph, the control unit 311 switches to the stopping of the automatic photographing mode according to the photographing intention information. Then, the processing proceeds to a process in step SP53.

(Step SP53)

The control unit 311 determines whether or not the automatic photography switch 703 receives a pressing operation. If the determination is affirmative, the processing proceeds to a process in step SP54. On the other hand, if the determination is negative, the processing proceeds to a process in step SP55.

(Step SP54)

The control unit 311 switches to the stopping of the automatic photographing mode when the automatic photographing mode is executed, whereas the control unit 311 switches to the executing of the automatic photographing mode when the automatic photographing mode is stopped. Then, the processing proceeds to a process in step SP55.

(Step SP55)

The control unit 311 determines whether or not the sitting detection sensor 413 detects the sitting of the user on the toilet seat 41. If the determination is affirmative, the processing proceeds to a process in step SP56. On the other hand, if the determination is negative, the sequential processing illustrated in FIG. 7 is ended.

(Step SP56)

The control unit 311 determines whether or not the automatic photographing mode is set to be executed. If the determination is affirmative, the processing proceeds to a process in step SP57. On the other hand, if the determination is negative, the sequential processing illustrated in FIG. 7 is ended.

(Step SP57)

The control unit 311 controls the image sensor 44 to start automatic photographing which involves automatically photographing the inside of the bowl 91. Then, the processing proceeds to a process in step SP58.

(Step SP58)

The communication unit 313 transmits the image obtained by the automatic photography to the external cloud service C2. The cloud service C2 determines the presence or absence of user's feces or the properties of the user's feces, such as the color, shape, and amount of the feces, from the received image, and informs the user of determination results.

<Action and Effects>

In the second embodiment, the control unit 311 can acquire the photographing intention information via the identification switches 704 to 707. Thus, the control unit 311 can save the user's efforts, compared to a case where photographing intention information is acquired from the outside, such as the portable information terminal C1 or cloud service C2, and therefore can acquire photographing intention information without any communication environment with the outside.

Modifications

The present invention is not limited to the embodiments described above. That is, the above embodiments with appropriate design changes made by those skilled in the art are also included in the scope of the present invention as long as they have the features of the present invention.

For example, the first embodiment has described an example in which the operating device 7 includes the stop instruction switch 701 and the photography instruction switch 702, but these switches may be omitted entirely or partially. The stop instruction switch 701 and the photography instruction switch 702 may be applied to the toilet apparatus 1A of the second embodiment. Further, a case where the stop instruction unit is the stop instruction switch 701 has been described, but the stop instruction unit may be the display unit 72, the portable information terminal C1, or the cloud service C2. Similarly, a case where the photography instruction unit is the photography instruction switch 702 has been described, but the photography instruction unit may be the display unit 72, the portable information terminal C1, or the cloud service C2.

Farther, the second embodiment has described a case where the user is identified via the identification switches 704 to 707, but the user may be identified by a user's operating method or operating contents of the operating device 7. Furthermore, the operating device 7 may function as a user identification device for identifying the user. For example, the operating device 7 identifies the user through the personal authentication. The operating device 7 may identify the user based on biometric information, such as the user's fingerprints, veins, weight, and the iris of the eyes. Through communication between the portable information terminal C1 and the toilet apparatus 1, the portable information terminal C1 or toilet apparatus 1A may identify the user by conducting personal authentication of the user. Alternatively or additionally, the user may be identified by causing the toilet apparatus 1A to read the identification card owned by the user.

Moreover, the first embodiment has described a case where the control unit 311 turns off the illumination of the image sensor 44 when not conducting the automatic photographing. However, when not conducting automatic photographing, the control unit 311 may control a shielding member (not shown) provided on the toilet seat 41 to conceal a lens portion of the image sensor 44, whereas when conducting the automatic photographing, the control unit 311 may control the shielding member (not shown) provided on the toilet seat 41 with the lens portion of the image sensor 44 exposed thereto. This can further prevent discomfort to users who do not wish to have the inside of the bowl 91 automatically photographed.

In addition, the first embodiment has described a case where the image sensor 44 is provided on the back of the toilet seat 41, but the image sensor 44 may be provided in any position of the toilet seat 41 other than its back, such as the side of the toilet seat 41. Alternatively or additionally, the image sensor 44 may be provided on the toilet bowl 9, the operating device 7, the toilet room R, and the like.

REFERENCE SIGNS LIST

1, 1A Toilet apparatus
9 Toilet bowl
41 Toilet seat
44 Image sensor
91 Bowl
311 Control unit
413 Sitting detection sensor (sitting detection unit)
701 Stop instruction switch (stop instruction unit)
702 Photography instruction switch (photography instruction unit)

What is claimed is:

1. A toilet apparatus comprising:
a toilet seat disposed above a toilet bowl;
an image sensor photographing an inside of a bowl of the toilet bowl; and
a control unit controlling the image sensor to execute an automatic photographing mode of automatically photographing the inside of the bowl,
wherein, when acquiring a user's photographing intention information indicating whether or not the user has an intention to photograph the inside of the bowl, the control unit switches between executing and stopping of the automatic photographing mode based on the acquired photographing intention information.

2. The toilet apparatus according to claim 1, further comprising:
a stop instruction unit receiving a stop instruction provided by the user,
wherein the control unit switches the automatic photographing mode from executing to stopping when the stop instruction unit receives the stop instruction while the automatic photographing mode is being executed.

3. The toilet apparatus according to claim 2, wherein, when switching the automatic photographing mode from executing to stopping, the control unit deletes an image obtained by the photographing before the stopping.

4. The toilet apparatus according to claim 2, further comprising:
a sitting detection unit detecting sitting of the user on the toilet seat,
wherein the control unit starts photographing in the automatic photographing mode when a predetermined time elapses after the sitting detection unit detects the sitting, and the control unit switches the automatic photographing mode from executing to stopping if the stop instruction unit receives the stop instruction during the predetermined time.

5. The toilet apparatus according to claim 2, further comprising:
a photography instruction unit receiving a photography instruction provided by the user,
wherein the control unit switches the automatic photographing mode from stopping to executing when the photography instruction unit receives the photography instruction.

* * * * *